US005503925A

United States Patent [19]

Nakano et al.

[11] Patent Number: 5,503,925

[45] Date of Patent: Apr. 2, 1996

[54] COATED CEMENTED CARBIDES

[75] Inventors: Minoru Nakano; Katsuya Uchino, both of Itame, Japan

[73] Assignee: Sumitomo Electric Industries, Ltd., Osaka, Japan

[21] Appl. No.: 340,467

[22] Filed: Nov. 14, 1994

Related U.S. Application Data

[63] Continuation of Ser. No. 26,805, Mar. 5, 1993, abandoned.

[30] Foreign Application Priority Data

| | | | |
|---|---|---|---|
| Mar. 5, 1992 | [JP] | Japan | 4-84424 |
| Apr. 17, 1992 | [JP] | Japan | 4-1255432 |
| Jun. 5, 1992 | [JP] | Japan | 4-171697 |

[51] Int. Cl.[6] ..... C23C 16/30

[52] U.S. Cl. ..... 428/336; 428/212; 428/216; 428/217; 428/467; 428/472; 428/677; 428/698; 428/697

[58] Field of Search ..... 428/698, 472, 428/469, 216, 336, 212, 217, 697, 699

[56] References Cited

U.S. PATENT DOCUMENTS

| | | | |
|---|---|---|---|
| 3,690,962 | 9/1972 | Rudy | 428/698 |
| 4,698,266 | 10/1987 | Buljan et al. | 428/457 |
| 4,743,515 | 5/1988 | Fisher et al. | 428/698 |

FOREIGN PATENT DOCUMENTS

| | | |
|---|---|---|
| 0337696 | 10/1989 | European Pat. Off. . |
| 1133995 | 11/1968 | United Kingdom . |

OTHER PUBLICATIONS

Sarin, "Cemented Carbide Cutting Tools" Advances in Powder Technology, Material Science Seminar, Louisville KT ed. G. Y. Chin 1981.

*Primary Examiner*—A. A. Turner
*Attorney, Agent, or Firm*—Wenderoth, Lind & Ponack

[57] ABSTRACT

Coated cemented carbides used for cutting tool and having improved resistance to chipping without sacrificing resistance to wear.

They comprise a substrate comprising WC, at least one iron-family metal forming a binder phase and a hard phase in which a hard phase comprising at least one element selected from the group consisting of carbides, nitrides and carbonitrides of metal containing Zr and/or Hf as a main component coexists with a hard phase comprising at least one element selected from the group consisting of carbides, nitrides and carbonitrides of metal containing Ti as a main component, and at least one coating layer formed on said substrate, said coating layer comprising at least one element selected from the group consisting of a carbide, nitride, oxide and boride of a metal that belongs to the IVa, Va and VIs groups and aluminum oxide.

12 Claims, No Drawings

COATED CEMENTED CARBIDES

This application is a continuation of now abandoned application Ser. No. 08/026,805, filed Mar. 5, 1993 now abandoned.

The present invention relates to coated cemented carbides excellent in toughness and wear resistance for use as a material for cutting tools.

A demand for higher cutting efficiency is increasing these days. As material for cutting tools which meet this demand, cemented carbides having a coating layer of titanium carbide, etc. deposited on their surface are now widely used because they provide both toughness by the substrate and wear resistance by the surface layer.

The cutting efficiency depends on the cutting speed (V) and the feed rate (f). But the tool life tends to shorten markedly with the increase in cutting speed. Thus, in order to improve the cutting efficiency, it was an ordinary practice to increase the feed rate. In order to increase the feed rate, however, high toughness is required for the substrate to meet high cutting stress. One solution is to increase the amount of a binder phase in the cemented carbide substrate. Another solution is to increase both the cutting speed (V) and the feed rate (f).

Though the toughness can be increased by increasing the amount of the binder phase, the tool made of such a material tends to suffer plastic deformation at its edge if it is used for high-speed cutting. In order to provide a cutting tool which can withstand high-speed cutting conditions and which has a long life and higher heat resistance, it is known to increase the content of Ti in the cemented carbide or that of carbides of Ta, Nb, etc., which belong to the Va and VIa groups in the periodic table. But the addition of such elements tends to result in a marked reduction in the strength of the cemented carbide.

An object of the present invention is to provide a coated cemented carbide for cutting tools which shows higher wear resistance and toughness under high-efficiency cutting conditions.

In order to attain this object, the present invention provides a coated cemented carbide comprising a substrate comprising WC, at least one iron-family metal forming a binder phase and a hard phase comprising at least two elements selected from the group consisting of a carbide, nitride and carbonitride of metal that belongs to the IVa, Va and VIa groups of the peridic table, and at least one coating layer formed on the substrate, the coating layer comprising at least one element selected from the group consisting of a carbide, nitride, oxide and boride of a metal that belongs to the IVa, Va and VIa groups and aluminum oxide, characterized in that in the hard phase, a hard phase comprising at least one element selected from the group consisting of carbides, nitrides and carbonitrides of metal containing Zr and/or Hf as a main component coexists with a hard phase comprising at least one element selected from the group consisting of carbides, nitrides and carbonitrides of metal containing Ti as a main component.

Now we shall describe the reason why the abovesaid structure is adopted in the present invention. It is a known practice to add carbides, etc. of metals that belong to the 4a, 5a and 6a groups in the periodic table to a cemented carbide in order to increase its wear resistance. But such carbides tend to form a solid solution with WC and thus to reduce the content of WC, which has the highest strength in the cemented carbide, thereby reducing its strength.

Among the carbides, nitrides and carbonitrides of metals that belong to the 4a, 5a and 6a groups, those of Zr and Hf are the most effective in increasing the strength at room temperature and high temperatures if they are added to the cemented carbide. Thus, it is considered that a cemented carbide containing carbide, nitride or carbonitride of Zr and/or Hf is the most desirable cemented carbide in a practical sense. But there are very few tools made of cemented carbides, containing carbides or nitrides of Zr or Hf, which belong to the 4a group. This is presumably because of low hardness and poor wear resistance of these carbides, nitrides and carbonitrides.

The cemented carbides according to the present invention contain hard phases which comprise carbides, nitrides and carbonitrides of Zr and/or Hf to maintain high strength of the cemented carbide, and which comprise carbides, nitrides and carbonitrides of Ti to ensure high hardness of the cemented carbide, and they coexist with each other.

Namely, we found that the addition of carbides, nitrides or carbonitride of Zr and/or Hf in the cemented carbide serves to inhibit the formation of a solid solution of WC with carbides, nitrides or carbonitrides of Ti and that this phenomenon can be utilized to provide a cemented carbide which is excellent in both hardness and strength.

Ti, Zr and Hf may be added to the cemented carbide in the form of carbides or carbonitrides obtained by forming a solid solution with W, Ta, Nb, V, etc. Carbides, nitrides or carbonitrides of Ti, which coexist with carbides, nitrides or carbonitrides of Zr or Hf, may be in the form of solid solutions with carbides, nitrides or carbonitrides of of Zr or Hf. Also, carbonitrides of Zr may be solid solutions with carbonitrides of Hf.

In order to allow carbides, nitrides or carbonitrides of Zr and/or Hf to coexist with carbides, nitrides or carbonitrides of Ti, it is necessary that the following formula is satisfied:

In accordance with the present invention, the following formula should be satisfied:

$$0.2 \leqq M1(M1+M2) \leqq 0.9$$

wherein:

M1 is the molar weight of ZP and Hf in said hard phase comprising at least one element selected from the group consisting of carbides, nitrides and carbonitrides of metal containing Zr and/or Hf as a main component; and M2 is the molar weight of Ti in said hard phase comprising at least one element selected from the group consisting of carbides, nitrides and carbonitrides of metal containing Ti as a main component.

If less than 0.2, it is difficult to allow coexistence of the hard phase comprising carbides, nitrides or carbonitrides containing Zr and/or Hf with the hard phase comprising carbides, nitrides or carbonitrides containing Ti. Namely, if less than 0.2, the possibility of the formation of complex carbides, etc. increases, which will make it difficult to attain the object of the present invention. If more than 0.9, the hardness of the cemented carbide will be insufficient. Preferable range is 0.3– 0.7.

Further, the cemented carbide according to the present invention has, immediately under the coating layer, a surface layer. This layer does not contain at all the hard phase comprising at least one element selected from the group consisting of carbides, nitrides and carbonitrides containing metals which belong to the 5a and 6a groups in the periodic table and does not contain at all or contains in a reduced amount the hard phase comprising at least one element selected from the group consisting of carbides, nitrides and carbonitrides of metal containing Zr and/or Hf as a main component and the hard phase comprising at least one element selected from the group consisting of carbides, nitrides and carbonitrides of metal containing Ti as a main component. It should have a thickness of 2–100 microns.

If the surface layer does not contain at all the hard phase comprising at least one element selected from carbides, nitrides and carbonitrides containing Zr and/or Hf as a main component and the hard phase comprising at least one element selected from carbides, nitrides and carbonitrides containing Ti as a main component, this layer consists essentially of WC and a binder phase.

This structure serves to improve the toughness of the surface of the cemented carbides. It is known that the use of nitrides or carbonitrides of Ti leads to the disappearance of nitrides, etc. of Ti on the surface (as evidenced by Japan Metal Association Journal, volume 45-1, 95). It is also known that such Ti nitrides remain along the cutting edge of the tool. Further, it is known that if a cemented carbide containing nitrides, etc. of Ti is heated to a temperature over 1500° C., the Ti nitrides that remain along the cutting edge disappear (see Material Science and Engineering, 1988, 225–234). In contrast, in the cemented carbide according to the present invention, where nitrides, etc. of Zr and Hf are added, carbides, nitrides or carbonitrides of Ti as well as carbides, nitrides or carbonitrides of metals that belong to the 5a and 6a groups are not present at all or present in a reduced amount in the surface layer, even though the cemented carbide is subjected not to heat treatment at a temperature exceeding 1500° C. but simply to ordinary sintering. It turned out that the cutting edge of a tool made of this cemented carbide shows much higher toughness than that made of a conventional cemented carbide.

The thickness of such a surface layer should be between 2 and 100 microns. If less than 2 microns, it is impossible to improve the toughness. If more than 100 microns, the wear resistance will be insufficient. Preferred range is 5–50 microns.

The thickness of the surface layer can be controlled by adding to the cemented carbides the hard phase comprising at least one element selected from carbides, nitrides and carbonitrides of metal containing Zr and/or Hf, the hard phase comprising at least one element selected from carbides, nitrides and carbonitrides containing Ti, or the hard phase containing metals that belong to the 5a and 6a groups, and by keeping them under vacuum or under a predetermined nitrogen pressure at 1350°–1500° C., and controlling the period of time for keeping.

It is an ordinary practice to grind, after sintering, any portions of a tool which are not used for actual cutting operation (such as a seat surface of a throw away insert) to improve the dimensional accuracy (of e.g. thickness). Thus, at the seat portion, the surface layer is removed. A coating layer is formed in this state. In other words, a tool made by the cemented carbide according to the present invention is not always covered with the surface layer over its entire surface.

A solid solution may be formed a little between the hard phases comprising at least one element selected from carbides, nitrides and carbonitrides of metal containing Zr and/or Hf as a main component and the hard phase comprising at least one element selected from carbides, nitrides and carbonitrides of metal containing Ti as a main component, which coexist in the cemented carbide. The solid solution tends to increase in amount especially if the binder phase is contained in a large amount because this tends to increase the precipitation of solute elements. But, in principle, it is considered that the hard phase comprising at least one element selected from carbides, nitrides and carbonitrides of metal containing Zr and/or Hf as a main component coexist with the hard phase comprising at least one element selected from carbides, nitrides and carbonitrides of metal containing Ti as a main component.

Immediately under the surface layer, the cemented carbide of the present invention may have a layer which contains the hard phase comprising at least one element selected from carbides, nitrides and carbonitrides of metal containing Ti as a main component in a larger amount than does the further inner portion of the cemented carbide. Its thickness should be 1–50 microns.

A hard phase of carbides, nitrides or carbonitrides containing Ti as a main component provided inside the surface layer minimizes plastic deformation of the cutting edge due to a rise in tool temperature. If the thickness of this layer is less than 1 micron, the above-described effect will not reveal. If more than 50 microns, the toughness of the tool will decrease. Preferred range is 5–10 microns.

This layer is presumably produced by the precipitation of only carbides, nitrides and carbonitrides of Ti from a liquid phase after the hard phases of Zr and/or Hf have disappeared. This layer may be formed by the precipitation of complex carbides and complex nitrides produced by the reaction between Ti and WC and may contain elements in the 5a and 6a groups. Namely, this layer comprises WC, carbides or carbonitrides containing Ti, carbides or carbonitrides containing Ti and WC, and binder phase metals.

Under the surface layer, the above-described layer has a thickness of 1–50 microns and has a maximum Hv hardness of 1400–1900 kg/mm$^2$ with the load of 500 g applied. If less than 1400 kg/mm$^2$, this layer will not serve to reduce the plastic deformation of the tool cutting edge. If more than 1900 kg/mm$^2$, the toughness will decrease. Preferable range is 1500°–1700 kg/mm$^2$.

This layer is obtainable by adjusting the molar ratio between the molar weight (M1) of Zr and Hf contained in the hard phase comprising at least one element selected from carbides, nitrides and carbonitrides of metal containing Zr and/or Hf as a main component and the molar weight (M2) of Ti contained in the hard phase comprising at least one element selected from carbides, nitrides and carbonitrides of metal containing Ti as a main component within a range between 0.2–0.9, preferably between 0.3–0.8 and holding them under vacuum or under a predetermined nitrogen pressure at 1350°–1500° C. By controlling the holding time, the thickness and the maximum hardness of the layer can be controlled. Generally, the larger the amount of the hard phases containing Ti, i.e. the smaller the ratio of M1 to M2, the larger the thickness of the layer of carbides, nitrides or carbonitrides containing Ti and the higher its maximum hardness.

Also, immediately under the coating layer, the cemented carbide should have a layer comprising WC grains having a larger grain size than the WC grains further inside the cemented carbide. Its thickness should be 1–100 microns.

By providing the layer comprising WC grains having a larger grain size, the cemented carbide shows higher resistance to cracks which tend to occur during cutting operation. A tool made of such a cemented carbide is less likely to suffer from chipping. If the thickness of this layer is less than 1 micron, no effect will be obtainable. If more than 100 microns, the wear resistance will decrease. Preferable range is 5–10 microns, The size of the WC grains in this layer should be 1.5– 5 times the size of the WC grains in the inner portion. If the layer made up of coarse WC grains is 1-micron thick, the average grain size of WC grains in this layer will be about 0.5 micron. It is possible to strengthen the effect of this structure by combining this structure with any of the above-described structures.

It is not known why this layer is formed. But this layer can be formed by adding carbides or carbonitrides of Zr and/or Hf to the cemented carbide and heating it to a temperature of 1320°–1360° C. in a nitrogen atmosphere. The grain size of WC grains can be controlled by varying the nitrogen pressure, holding temperature and time and the carbon content in the cemented carbide. Generally, if the cemented carbide contains a great amount of carbon so that there exists free carbon in it, or if we control the nitrogen pressure lower, we can obtain easily coarse WC grains.

One way to increase the grain size of the WC grains which are present in the surface layer of the cemented carbide is disclosed in Unexamined Japanese Patent Publication 3-190604. But the technique disclosed in this publication can increase the grain size only to 1.2 times. It is utterly impossible to increase the grain size up to 1.5 times or more as in the present invention.

Also, immediately under the coating layer, the cemented carbide has a layer containing a greater amount of binder phase than the inner portion of the cemented carbide. Its thickness should be 1–100 microns. This layer serves to increase the toughness of the surface as well as the toughness of the tool. If the thickness is less than 1 micron, no desired effect is attainable. If more than 100 microns, the wear resistance will drop. Preferred range is 5–30 microns.

By continuously reducing the content of binder phase from the point where its content is the maximum toward the surface of the cemented carbide, better balance between toughness and wear resistance is attainable. The content of binder phase may be reduced near the surface of cemented carbide to increase the hardness near the surface. This makes it possible to minimize the wear of the tool after the coating layer has been worn out due to cutting operation. Any tensile stress that may act on the layer rich in the binder phase after sintering due to the difference in thermal expansion coefficients between this layer and the further inner layer can be reduced by reducing the content of binder phase near the surface. Thus, the cemented carbide can maintain its high toughness.

This layer can be formed by controlling the degree of vacuum or nitrogen pressure of the sintering atmosphere to 1–5 torr or less while nitrides and carbonitrides of Zr, etc. are disappearing or decreasing in amount or while the WC grains in the surface layer of the cemented carbide are growing in size. Otherwise, this layer can be formed by cooling the cemented carbide at the rate of 5° C./min or less under high vacuum.

Also, the cemented carbide according to the present invention has, immediately under the coating layer, a layer having a thickness of 0.01–3.00 microns and comprising nitrides or carbonitrides of Zr and/or Hf. This layer serves to improve the bond strength between the substrate and the coating layer and to prevent tool wear if the coating layer is damaged or worn out during cutting.

If its thickness is less than 0.01 micron, these effects will not reveal. If more than 3.00 microns, the cemented carbide will lose its toughness. Preferable range is 0.5–2.0 microns. This layer can be formed by holding the cemented carbide in a nitrogen atmosphere at a temperature higher than the temperature at which a liquid phase appears. Its thickness is controlled by adjusting the nitrogen pressure, holding temperature and holding time.

Another feature of the present invention is that the substrate contains 0.03–0.3 wt % of oxygen. The difficulty of sintering is considered to be one reason why conventional cemented carbides containing carbides, etc. of Zr were not used for actual tools. Sintering is difficult because Zr has a high affinity for oxygen. More specifically, a cemented carbide containing carbides, etc. of Zr contains a large amount of oxygen and thus a large amount of gas generates during sintering and the sintering level tends to lower. The lower wettability with liquid phase is another reason for this. It is believed that the lower the wettability, the lower the sinterability.

According to the present invention, this problem is solved by controlling the oxygen content within the above-defined range. It was also found out that a cemented carbide containing oxygen shows improved cutting performance when compared with a cemented carbide not containing oxygen. The oxygen content can be controlled by adjusting the oxygen content in the starting material or by heating in a reducing atmosphere. If the oxygen content is less than 0.03 wt %, no improvement in the cutting performance is expected. If more than 0.3 wt %, sintering will become extremely difficult. Preferable range is 0.05– 0.15 wt %.

Another feature of the present invention is that the substrate contains 0.05–0.4 wt % of nitrogen. Nitrides of Zr and Hf are thermodynamically stable and thus hardly decompose during sintering. Thus, it is possible to provide a cemented carbide containing a fairly large amount of nitrogen. This means that the cemented carbide contains nitrides at a large rate. Generally, nitrides of Zr, etc. have excellent thermal properties such as high thermal conductivity in comparison with carbides. This will improve the tool characteristics.

The nitrogen content can be controlled by adjusting the content of nitrides or carbon in the cemented carbide or by using nitrogen atmosphere during the heating and sintering and controlling its pressure. If the nitrogen content is less than 0.05 wt %, the abovementioned effect will not reveal. If more than 0.4 wt %, the sinterability will decrease. It should preferably be 0.07–0.25 wt %.

A coating layer is provided on the cemented carbide substrate thus formed. The coating layer is single-layered or multi-layered and comprises at least one element selected from the group consisting of carbides, nitrides, oxides and borides of metals that belong to the 4a, 5a and 6a groups in the periodic table and aluminum oxide. This layer may be formed with an ordinary CVD or PVD method. The coating layer serves to improve the wear resistance of the cemented carbide.

The coated cemented carbides according to the present invention show improved resistance to chipping while keeping high wear resistance. A cutting tool made of this material can be used with such high efficiency that has heretofore been unattainable.

EXAMPLE 1

As powder materials, we prepared WC, ZrC, ZrN, HfC, HfN, (Zr, Hf)C containing 50 mol % of ZrC, TiC, TiN, (Ti, W)C containing 30% by weight of TiC and 25% by weight of TiN, TaC, (Zr, W)C containing 90 mol % of ZrC, (Hf, W)C containing 90 mol % of HfC and (Ti, Hf)C containing 50 mol % of TiC and HfC, TaN, Co and Ni. Powders having compositions shown in Tables 1–4 (numeric values are in weight percentage except that M1/(M1+M2), is a molar ratio) were pressed into inserts having the shape set forth in CNMG 120408. The inserts thus made were heated in an $H_2$ atmosphere to 1000°–1450° C. at the heating rate of 5°

C./min., held for one hour under vacuum and cooled down. The oxygen contents in these cemented carbides were 0.04 wt % on the average. On each of these substrates were formed a 5-micron thick inner layer of TiC and then a 1-micron thick outer layer of aluminum oxide with an ordinary CVD method.

The samples thus formed were tested for cutting performance. The tests were performed under the following conditions. Test 1 is for evaluating the resistance to wear of flank. Test 2 is for evaluating the resistance to chipping.

Test 1 (wear resistance test)

Cutting Speed: 350m/min

Material to be cut: SCM415

Feed Rate: 0.5 mm/rev

Cutting Time: 20 min

Depth of Cut: 2.0 mm

Test 2 (test for resistance to chipping)

Cutting Speed: 100 m/min

Material to be cut: SCM435 4-grooved material

Feed Rate: 0.2–0.4mm/rev

Cutting Time: 30 sec

Depth of Cut: 2.0 mm

Number of test: 8

The test results for the above samples and the comparative samples are shown in Tables 5 and 6. Comparative Sample 1 comprises 4 wt % of (Ti, W, Ta)C and 6 wt % of Co. Comparative Sample 2 comprises 4 wt % of (Ti, W, Ta)C and 10 wt % of Co. Comparative Sample 3 comprises 4 wt % of (TiW)C and 6 wt % of Co. Comparative Sample 4 comprises 4 wt % of (TiW)C and 10 wt % of Co. Carbides of Zr and Hf, etc. were present in the cemented carbide in the form of carbonitrides. Carbides, etc. of Ti were present in the form of complex carbides resulting from reaction with TaC. The layer A in the tables is a layer which contains no hard phase of carbides of Zr or Hf near the surface of the cemented carbide.

EXAMPLE 2

Sample Nos. 10–16 and 41–47 shown in EXAMPLE 1 were heated under the same conditions as in EXAMPLE 1 and held for one hour in 2-, 10- and 50-torr $N_2$ atmospheres at 1400° C. to form a layer comprising only WC and a binder phase (WC-Co layer) over the entire surface of the cemented carbide. On each of the substrates thus made, TiC and TiN inner layers, each 3-micron thick, were formed. Then, a 4-micron thick outer layers $Al_2O_3$ was formed thereon. The samples thus formed were subjected to cutting tests similar to those in EXAMPLE 1. The results are shown in Tables 7 and 8.

In the Samples 10–16, carbonitrides of Zr, carbonitrides of Hf and complex carbides of (Ti, W, Ta)C coexisted. In the Samples 41–47, carbonitrides of Zr and/or Hf and double carbides of (Ti, W)C coexisted. In the Samples 12–14 and 43–45, inside the layer consisting of only WC and Co, there was a region containing WC, a binder phase and carbonitrides of Ti or (Ti, W)CN. This region is hereinafter referred to as layer B. Layers B in Samples 10–12 were made up of (Ti, Ta)CN. Layers B in Samples 41– 43 comprised TiCN. Layers A in Samples 13–16 comprised (Ti, W, Ta)CN. Layers A in Samples 44–47 comprised (Ti, W)CN.

EXAMPLE 3

Sample Nos. 1, 3, 7, 8, 9, 32, 34, 38 39 and 40 of EXAMPLE 1 were heated under vacuum, held for one hour at 1450° C., held for one hour at temperature of 1320°–1360° C. in the nitrogen atmosphere kept at 5 torr, and cooled. These cemented carbides were used as substrates and on each of the substrates were formed coating layers similar to those EXAMPLE 2.

The samples thus made were subjected to cutting tests similar to those in EXAMPLE 1. These cemented carbides contained 0.15 wt % of oxygen. Table 9 and 10 show the thickness of the layer containing coarse WC grains in each cemented carbide and the rate of coarse grains and the thickness of the region containing a greater amount of binder phase, together with the results of the cutting tests.

In the tables, the rate of coarse grains represents the average ratio of the coarse WC grains to the WC grains present further inside the cemented carbide. It was found out that, in the cemented carbides which were held at 1320° C., the content of binder phase decreased continuously from the area where the amount of binder phase is rich toward the surface of the cemented carbide. Among the cemented carbide samples which were held at 1340°–1360° C., Samples 1 and 32 contained a 0.5-micron thick layer of carbonitride of Zr, Samples 3 and 34 contained the same layer 0.8 micron thick, and Samples 7, 8, 9, 38, 39 and 40 contained a 0.6-micron thick layer of carbonitride of Hf. By increasing the nitrogen pressure by the factor of from two to four, the thicknesses of these layers increased by the factor of about 1.2 to 2, while the thickness of the layer containing coarse WC grains decreased sharply.

EXAMPLE 4

Sample Nos. 1 and 32 of EXAMPLE 1 were heated at the rates of 15° C./min, 10° C./min, 5° C./min, 1° C./min (A1, A2, A3 and A4). The respective cemented carbides contained 0.35, 0.20, 0.15 and 0.05 wt % of oxygen. A1 contained a large number of cavities in the cemented carbide. Few cavities were observed in A4. A2 and A3 contained moderate numbers of cavities.

Coating layers similar to those of EXAMPLE 2 were formed on these cemented carbides. The samples were subjected to cutting tests similar to those in EXAMPLE 1 except that the cutting speed was increased to 450 m/min. A1 suffered chipping at the initial stage of the tests. The other samples showed wear resistance 1.1–1.5 times higher than Samples 1 and 32 of EXAMPLE 1. This result indicates that the oxygen content should be 0.03–0.3 wt %, preferably 0.05–0.15 wt %.

EXAMPLE 5

The nitrogen contents in Samples 10–16 and 41–47 of EXAMPLE 1 were analyzed. The results are shown in Tables 11 and 12 (vacuum). These samples were heated from 1200° C. to the sintering temperature at the rate of 5° C./min in the nitrogen atmosphere. Changes in the nitrogen content due to changes in the nitrogen pressure are shown in Tables 11 and 12. As will be apparent from these tables, the nitrogen content can be controlled by changing the nitrogen pressure.

EXAMPLE 6

Powder having the same composition as the Sample 48 (WC-4% TiC-2% ZrN-6% Co in weight %) was pressed into inserts having the shape of CNMG120408. These inserts were heated to 1450° C. under vacuum and held for one hour under the nitrogen pressure of 5, 10, 30 and 50 torr, respectively. Then they were cooled. Four different kinds of substrates were obtained. On each of these substrates, a 5-micron thick TiC coating and then a 1-micron thick aluminum oxide coating were formed with the ordinary CVD method. These cemented carbides are hereinafter referred to as Samples 63, 64, 65 and 66.

The analysis of these cemented carbides revealed that the nitrides of Zr and a hard phase of TiC coexisted in the substrate and that there was a layer containing no hard phase, i.e. the layer A, near the substrate surface. The layers A in Samples 63, 64, 65 and 66 had a thickness of 50, 30, 10 and 5 microns, respectively. The layers A contained twice as large an amount of binder phase as in the inner area inside the substrate. The ratio between Zr and Ti, i.e. the ratio "Zr (mol)/(Ti (mol)+Zr (mol)" was 0.22. The stoichiometry ratio of the nitrides of Zr in the cemented carbide was 1 or less.

Samples 63, 64, 65 and 66 were subjected to cutting tests similar to tests 1 and 2 of EXAMPLE 1 to evaluate the cutting performance. Comparative Samples 5 has the composition of WC-5% TiC-3% TaC-6% Co. The test results are shown in Table 13.

As shown in the Table 13, Comparative Sample 5 suffered the greatest number of chippings in any of the tests, while Samples 63-66 showed excellent wear resistance and toughness.

EXAMPLE 7

Powder obtained by adding, respectively, 4% TiN-2% ZrC, 2% TiC-4% ZrN and 2% TiC-8% ZrN to a WC-6% Co (wt %) composition were pressed into inserts having the shape of CNMG120408. These inserts were heated under vacuum from room temperature to 1300° C. at the rate of 10° C./min and then from 1300° C. to 1450° C. at the rate of 2° C./min and held at this temperature for an hour. Then they were cooled. Three different kinds of substrates were obtained. On each of these substrates, a 5-micron thick TiC coating and then a 1-micron thick aluminum oxide coating were formed with the ordinary CVD method. These cemented carbides are hereinafter referred to as Samples 67, 68 and 69.

The analysis of these cemented carbides revealed that in Sample 67, nitrides of Ti and carbonitrides of Zr coexisted, in Sample 68, carbonitrides of Ti and those of Zr coexisted and in Sample 69, carbonitrides of Ti and nitrides of Zr coexisted. In Samples 67 and 68, there existed a layer 10.5 microns thick in which hard phases of Ti and Zr disappeared, i.e. layer A. In Sample 69, there existed a layer in which only 5-micron thick carbonitride of Ti was gone with the nitrides of Zr remaining. The Zr-to-Ti ratios in Samples 67, 68 and 69 were 0.22, 0.54 and 0.70, respectively. These cemented carbides and Comparative Sample 5 were subjected to cutting tests similar to tests 1 and 2 of EXAMPLE 1. The test results are shown in Table 14.

As shown in this table, Samples 67, 68 and 69 revealed higher wear resistance and toughness than Comparative Sample.

EXAMPLE 8

Powder obtained by adding, respectively, 2% TiN-8% ZrC, 2% TiC-10% ZrN, 1% TiC-8% ZrN and 1% TiC-10% ZrN to a WC-6% Co composition were pressed into inserts having the shape of CNMG120408. These inserts were heated under vacuum from room temperature to 1250° C. at the rate of 10° C./min and then from 1250° C. to 1450° C. at the rate of 2° C./min and held at this temperature for an hour under vacuum or under the nitrogen pressure of 5 torr. Then they were cooled. Four different kinds of substrates were obtained. On each of these substrates, a 5-micron thick TiC coating was formed and then a 1-micron thick aluminum oxide coating was formed thereon with the ordinary CVD method. These cemented carbides are hereinafter referred to as Samples 70, 71, 72 and 73.

The analysis of these cemented carbides revealed that, in Samples 70–73, carbides, nitrides or carbonitrides of Ti and those of Zr coexisted. The samples which were treated under vacuum contained no carbides, nitrides or carbonitrides of Ti near the substrate surface and those treated under the nitrogen pressure of 5 torr contained these elements in reduced amounts near the substrate surface. The ratios between Zr and Ti in Samples 70–73 were 0.70, 0.74, 0.82, 0.85, respectively. These samples were subjected to cutting tests similar to those in EXAMPLE 1. The test results and the thicknesses of the layers containing no or reduced amounts of carbides, nitrides or carbonitrides of Ti are shown in Table 15.

As shown in this table, the samples according to the present invention revealed higher wear resistance and toughness.

EXAMPLE 9

Sample Nos. 18 and 48 of EXAMPLE 1 were heated under the same heating conditions as in EXAMPLE 1 and held at 1450° C. for one hour under a high vacuum of $10^{-3}$ Torr to form, on the entire surface of the cemented carbides, a surface layer comprising only WC and binder phase (layer A consisting of WC and Co). The layer A formed on Sample 18 had the same thickness as in EXAMPLE 1, i.e. a thickness of 10 microns. The thickness of the layer A on Sample No. 48 was also 10 microns as in EXAMPLE 1. In either of Samples Nos. 18 and 48, the surface layer was richer in the amount of binder phase than the inner portion of the cemented carbide as in EXAMPLE 1. Only difference was that the content of binder phase decreased continuously toward the surface of the cemented carbide from the point where the content of the binder phase is the highest.

These samples were subjected to cutting tests under the same conditions as in Tests 1 and 2. In the tests, Sample No. 18 showed an amount of abrasion of 0.19 mm and a chipping rate of 20% while Sample No. 48 showed an amount of abrasion of 0.20 mm and a chipping rate of 21%. From these test results, it is apparent that the samples of this example have improved balance between wear resistance and chip resistance when compared with those of EXAMPLE 1.

TABLE 1

| | (wt %) | | | | | (wt %) | | | (wt %) | | | M1 |
|---|---|---|---|---|---|---|---|---|---|---|---|---|
| Sample | ZrC | ZrN | HfC | HfN | (Zr,Hf)C | TiC | TiN | (Ti,W)C | TaC | Co | WC | M1 + M2 |
| 1 | 2 | | | | | 2 | | | 2 | 6 | R | 0.37 |

TABLE 1-continued

| | (wt %) | | | | | (wt %) | | | (wt %) | | | M1 |
|---|---|---|---|---|---|---|---|---|---|---|---|---|
| Sample | ZrC | ZrN | HfC | HfN | (Zr,Hf)C | TiC | TiN | (Ti,W)C | TaC | Co | WC | M1 + M2 |
| 2 | 2 | | | | | | 2 | | 2 | 6 | " | 0.37 |
| 3 | 2 | | | | | | | 2 | 2 | 6 | " | 0.51 |
| 4 | | | | | 3 | 2 | | | 2 | 3 | R | 0.38 |
| 5 | | | | | 3 | 2 | | | 2 | 6 | " | 0.38 |
| 6 | | | | | 3 | 2 | | | 2 | 10 | " | 0.38 |
| 7 | | | | 4 | | | | 2 | 1 | 3 | R | 0.39 |
| 8 | | | | 4 | | | | 2 | 1 | 5 | " | 0.39 |
| 9 | | | | 4 | | | | 2 | 1 | 12 | " | 0.39 |
| 10 | 4 | | | 4 | | | 0.3 | | 1 | 10 | R | 0.93 |
| 11 | 4 | | | 4 | | | 0.5 | | 1 | 10 | " | 0.88 |
| 12 | 4 | | | 4 | | | | | 1 | 10 | " | 0.77 |
| 13 | 4 | | | 4 | | | 3 | | 1 | 10 | " | 0.58 |
| 14 | 4 | | | 4 | | | 6 | | 1 | 10 | " | 0.38 |
| 15 | 2 | | | 2 | | | 6 | | 1 | 10 | " | 0.24 |
| 16 | 1 | | | 1 | | | 6 | | 1 | 10 | " | 0.13 |
| 17 | | 4 | | | | 2 | | | 2 | 6 | R | 0.37 |
| 18 | | 4 | | | | | 2 | | 2 | 6 | " | 0.37 |
| 19 | | 4 | | | | | | | 2 | 8 | " | 0.37 |
| 20 | | | 4 | | | 2 | | | 2 | 6 | R | 0.38 |
| 21 | | | 4 | | | | 2 | | 2 | 6 | " | 0.38 |
| 22 | | | 4 | | | | | | 2 | 8 | " | 0.38 |

*R in the WC column represents "remainder".

TABLE 2

| | (wt %) | | (wt %) | | | (wt %) | | | | M1 |
|---|---|---|---|---|---|---|---|---|---|---|
| Sample | (Zr,W)C | (Hf,W)C | (Ti,W)C | TiC | (Ti,Hf)C | TaN | Co | Ni | WC | M1 + M2 |
| 23 | 2 | | 1 | | | 1 | 3 | | R | 0.64 |
| 24 | 2 | | 1 | | | 1 | 3 | 2 | " | 0.64 |
| 25 | 2 | | 1 | | | 1 | 4 | 2 | " | 0.64 |
| 26 | | 2 | | 1 | | 2 | 3 | | R | 0.36 |
| 27 | | 2 | | 1 | | 2 | 6 | | " | 0.36 |
| 28 | | 2 | | 1 | | 2 | 12 | | " | 0.36 |
| 29 | 2 | | | | 1 | 1 | 3 | | R | 0.89 |
| 30 | 2 | | | | 1 | 1 | 6 | | " | 0.89 |
| 31 | 2 | | | | 1 | 1 | 12 | | " | 0.89 |

*R in the WC column represents "remainder".

TABLE 3

| | (wt %) | | | | | (wt %) | | | (wt %) | | M1 |
|---|---|---|---|---|---|---|---|---|---|---|---|
| Sample | ZrC | ZrN | HfC | HfN | (Zr,Hf)C | TiC | TiN | (Ti,W)C | Co | WC | M1 + M2 |
| 32 | 2 | | | | | 2 | | | 6 | R | 0.37 |
| 33 | 2 | | | | | | 2 | | 6 | " | 0.37 |
| 34 | 2 | | | | | | | 2 | 6 | " | 0.51 |
| 35 | | | | | 3 | 2 | | | 3 | R | 0.38 |
| 36 | | | | | 3 | 2 | | | 6 | " | 0.38 |
| 37 | | | | | 3 | 2 | | | 10 | " | 0.38 |
| 38 | | | | 4 | | | | 2 | 3 | R | 0.39 |
| 39 | | | | 4 | | | | 2 | 5 | " | 0.39 |
| 40 | | | | 4 | | | | 2 | 12 | " | 0.39 |
| 41 | 4 | | | 4 | | | 0.3 | | 10 | R | 0.93 |
| 42 | 4 | | | 4 | | | 0.5 | | 10 | " | 0.88 |
| 43 | 4 | | | 4 | | | 1 | | 10 | " | 0.77 |
| 44 | 4 | | | 4 | | | 3 | | 10 | " | 0.58 |
| 45 | 4 | | | 4 | | | 6 | | 10 | " | 0.38 |
| 46 | 2 | | | 2 | | | 6 | | 10 | " | 0.24 |
| 47 | 1 | | | 1 | | | 6 | | 10 | " | 0.13 |
| 48 | | 4 | | | | 2 | | | 6 | R | 0.37 |
| 49 | | 4 | | | | | 2 | | 6 | " | 0.37 |

TABLE 3-continued

| | (wt %) | | | | | (wt %) | | | (wt %) | | M1 |
|---|---|---|---|---|---|---|---|---|---|---|---|
| Sample | ZrC | ZrN | HfC | HfN | (Zr,Hf)C | TiC | TiN | (Ti,W)C | Co | WC | M1 + M2 |
| 50 | | 4 | | | | | | | 8 | " | 0.37 |
| 51 | | | 4 | | | 2 | | | 6 | R | 0.38 |
| 52 | | | 4 | | | | 2 | | 6 | " | 0.38 |
| 53 | | | 4 | | | | | | 8 | " | 0.38 |

*R in the WC column represents "remainder".

TABLE 4

| | (wt %) | | (wt %) | | | | (wt %) | | | M1 |
|---|---|---|---|---|---|---|---|---|---|---|
| Sample | (Zr,W)C | (Hf,W)C | (Ti,W)C | TiC | (Ti,Hf)C | TiN | Co | Ni | WC | M1 + M2 |
| 54 | 3 | | 1 | | | 0.5 | 3 | | R | 0.59 |
| 55 | 3 | | 1 | | | 0.5 | 3 | 2 | " | 0.59 |
| 56 | 3 | | 1 | | | 0.5 | 4 | 2 | " | 0.59 |
| 57 | | 3 | | 1 | | 1 | 3 | | R | 0.30 |
| 58 | | 3 | | 1 | | 1 | 6 | | " | 0.30 |
| 59 | | 3 | | 1 | | 1 | 12 | | " | 0.30 |
| 60 | 10 | | | | 1 | 0.5 | 3 | | R | 0.87 |
| 61 | 10 | | | | 1 | 0.5 | 6 | | " | 0.87 |
| 62 | 10 | | | | 1 | 0.5 | 12 | | " | 0.87 |

*R in the WC column represents "remainder".

TABLE 5

| Sample | Test 1 (mm) | Test 2 (%) | Thickness of layer A (μm) |
|---|---|---|---|
| 1 | 0.24 | 22 | 0 |
| 2 | 0.23 | 20 | 2 |
| 3 | 0.25 | 22 | 0 |
| 4 | 0.16 | 50 | 0 |
| 5 | 0.20 | 25 | 0 |
| 6 | 0.28 | 15 | 0 |
| 7 | 0.15 | 48 | 3 |
| 8 | 0.19 | 28 | 3 |
| 9 | 0.29 | 25 | 3 |
| 10 | 0.35 | 57 | 2 |
| 11 | 0.32 | 30 | 2 |
| 12 | 0.30 | 25 | 3 |
| 13 | 0.27 | 20 | 4 |
| 14 | 0.25 | 22 | 5 |
| 15 | 0.24 | 35 | 7 |
| 16 | 0.25 | 55 | 8 |
| 17 | 0.23 | 18 | 7 |
| 18 | 0.22 | 19 | 10 |
| 19 | 0.27 | 20 | 2 |
| 20 | 0.14 | 45 | 3 |
| 21 | 0.18 | 27 | 3 |
| 22 | 0.27 | 23 | 3 |
| 23 | 0.18 | 51 | 1 |
| 24 | 0.20 | 30 | 1 |
| 25 | 0.21 | 28 | 1 |
| 26 | 0.17 | 50 | 2 |
| 27 | 0.20 | 30 | 2 |
| 28 | 0.25 | 17 | 2 |
| 29 | 0.20 | 49 | 0.5 |
| 30 | 0.25 | 31 | 0.5 |
| 31 | 0.29 | 16 | 0.5 |

Comparative sample
1 Chipped in 6 minutes: 96%
2 0.6 mm: 56%

TABLE 6

| Sample | Test 1 (mm) | Test 2 (%) | Thickness of layer A (μm) |
|---|---|---|---|
| 32 | 0.20 | 25 | 0 |
| 33 | 0.22 | 18 | 2 |
| 34 | 0.21 | 24 | 0 |
| 35 | 0.14 | 55 | 0 |
| 36 | 0.18 | 25 | 0 |
| 37 | 0.28 | 20 | 0 |
| 38 | 0.15 | 50 | 4 |
| 39 | 0.19 | 35 | 4 |
| 40 | 0.30 | 15 | 4 |
| 41 | 0.35 | 20 | 4 |
| 42 | 0.30 | 20 | 4 |
| 43 | 0.28 | 22 | 5 |
| 44 | 0.27 | 25 | 6 |
| 45 | 0.23 | 33 | 7 |
| 46 | 0.27 | 22 | 5 |
| 47 | 0.30 | 18 | 5 |
| 48 | 0.23 | 20 | 10 |
| 49 | 0.24 | 20 | 12 |
| 50 | 0.29 | 16 | 10 |
| 51 | 0.20 | 40 | 0 |
| 52 | 0.22 | 26 | 2 |
| 53 | 0.27 | 30 | 0 |
| 54 | 0.18 | 58 | 1 |
| 55 | 0.22 | 35 | 1 |
| 56 | 0.25 | 25 | 1 |
| 57 | 0.16 | 50 | 2 |
| 58 | 0.23 | 25 | 2 |
| 59 | 0.28 | 20 | 2 |
| 60 | 0.18 | 60 | 0.5 |
| 61 | 0.28 | 35 | 0.5 |
| 62 | 0.31 | 30 | 0.5 |

Comparative sample
3 Chipped in 6 minutes: 100%
4 0.65 mm: 60%

TABLE 7

| Sample | Nitrogen pressure (torr) | Thickness of WC-Co layer (μm) | B layer Thickness (μm) | B layer Hardness (kg/mm²) | Test 1 (mm) | Test 2 (%) |
|---|---|---|---|---|---|---|
| 10 | 2 | 20 | 5 | 1380 | 0.39 | 50 |
| | 10 | 10 | 2 | 1350 | 0.38 | 52 |
| | 50 | 3 | 1 | 1330 | 0.37 | 58 |
| 11 | 2 | 28 | 7 | 1420 | 0.34 | 25 |
| | 10 | 12 | 3 | 1410 | 0.33 | 27 |
| | 50 | 5 | 2 | 1400 | 0.31 | 30 |
| 12 | 2 | 35 | 13 | 1550 | 0.29 | 20 |
| | 10 | 11 | 8 | 1540 | 0.28 | 21 |
| | 50 | 4 | 3 | 1530 | 0.26 | 23 |
| 13 | 2 | 40 | 22 | 1650 | 0.28 | 18 |
| | 10 | 20 | 13 | 1650 | 0.25 | 20 |
| | 50 | 14 | 5 | 1640 | 0.22 | 21 |
| 14 | 2 | 50 | 30 | 1890 | 0.28 | 19 |
| | 10 | 30 | 20 | 1880 | 0.23 | 20 |
| | 50 | 10 | 8 | 1870 | 0.20 | 20 |
| 15 | 2 | 90 | 48 | 1750 | 0.26 | 25 |
| | 10 | 30 | 33 | 1740 | 0.27 | 28 |
| | 50 | 10 | 12 | 1730 | 0.25 | 30 |
| 16 | 2 | 80 | 55 | 1680 | 0.28 | 45 |
| | 10 | 30 | 40 | 1670 | 0.27 | 47 |
| | 50 | 15 | 15 | 1770 | 0.26 | 54 |

TABLE 8

| Sample | Nitrogen pressure (torr) | Thickness of WC-Co layer (μm) | B layer Thickness (μm) | B layer Hardness (kg/mm²) | Test 1 (mm) | Test 2 (%) |
|---|---|---|---|---|---|---|
| 41 | 2 | 25 | 5 | 1390 | 0.40 | 35 |
| | 10 | 13 | 3 | 1360 | 0.38 | 45 |
| | 50 | 5 | 2 | 1320 | 0.38 | 45 |
| 42 | 2 | 33 | 8 | 1430 | 0.31 | 25 |
| | 10 | 16 | 3 | 1410 | 0.30 | 29 |
| | 50 | 7 | 2 | 1390 | 0.35 | 35 |
| 43 | 2 | 40 | 15 | 1560 | 0.29 | 22 |
| | 10 | 20 | 7 | 1540 | 0.28 | 21 |
| | 50 | 6 | 3 | 1510 | 0.28 | 23 |
| 44 | 2 | 45 | 25 | 1660 | 0.26 | 30 |
| | 10 | 23 | 13 | 1650 | 0.25 | 26 |
| | 50 | 14 | 6 | 1640 | 0.22 | 23 |
| 45 | 2 | 50 | 30 | 1890 | 0.20 | 45 |
| | 10 | 35 | 20 | 1850 | 0.19 | 40 |
| | 50 | 15 | 8 | 1830 | 0.18 | 39 |
| 46 | 2 | 90 | 50 | 1770 | 0.26 | 58 |
| | 10 | 40 | 35 | 1740 | 0.27 | 30 |
| | 50 | 20 | 10 | 1710 | 0.25 | 27 |
| 47 | 2 | 80 | 55 | 1690 | 0.30 | 70 |
| | 10 | 30 | 45 | 1670 | 0.28 | 55 |
| | 50 | 15 | 20 | 1670 | 0.26 | 33 |

TABLE 9

| Sample | Temperature (°C.) | Layer containing rough WC grains: Thickness (μm) | Layer containing rough WC grains: Ratio of rough grains | Thickness of binder-phase-rich layer (μm) | Test 1 (mm) | Test 2 (%) |
|---|---|---|---|---|---|---|
| 1 | 1320 | 10 | 2.2 | 10 | 0.26 | 20 |
| | 1340 | 30 | 2.8 | 30 | 0.28 | 18 |
| | 1360 | 50 | 1.5 | 45 | 0.32 | 15 |
| 3 | 1320 | 5 | 2.0 | 5 | 0.27 | 20 |
| | 1340 | 20 | 2.3 | 25 | 0.29 | 15 |
| | 1360 | 40 | 1.7 | 40 | 0.30 | 13 |
| 7 | 1320 | 10 | 2.5 | 10 | 0.18 | 45 |
| | 1340 | 20 | 2.3 | 22 | 0.21 | 40 |
| | 1360 | 30 | 2.0 | 40 | 0.23 | 30 |
| 8 | 1320 | 20 | 1.9 | 22 | 0.22 | 23 |
| | 1340 | 30 | 1.8 | 35 | 0.23 | 20 |
| | 1360 | 52 | 1.7 | 55 | 0.25 | 19 |
| 9 | 1320 | 25 | 1.8 | 27 | 0.32 | 13 |
| | 1340 | 25 | 1.7 | 35 | 0.35 | 10 |
| | 1360 | 53 | 1.5 | 55 | 0.38 | 9 |

TABLE 10

| Sample | Temperature (°C.) | Layer containing rough WC grains: Thickness (μm) | Layer containing rough WC grains: Ratio of rough grains | Thickness of binder-phase-rich layer (μm) | Test 1 (mm) | Test 2 (%) |
|---|---|---|---|---|---|---|
| 32 | 1320 | 12 | 2.3 | 10 | 0.24 | 25 |
| | 1340 | 35 | 2.9 | 30 | 0.29 | 22 |

TABLE 10-continued

| Sample | Temperature (°C.) | Layer containing rough WC grains: Thickness (μm) | Layer containing rough WC grains: Ratio of rough grains | Thickness of binder-phase-rich layer (μm) | Test 1 (mm) | Test 2 (%) |
|---|---|---|---|---|---|---|
| | 1360 | 85 | 1.5 | 80 | 0.35 | 16 |
| 34 | 1320 | 6 | 2.0 | 7 | 0.27 | 22 |
| | 1340 | 25 | 2.5 | 26 | 0.30 | 20 |
| | 1360 | 60 | 1.6 | 60 | 0.33 | 18 |
| 38 | 1320 | 12 | 2.4 | 12 | 0.21 | 40 |
| | 1340 | 25 | 2.4 | 25 | 0.24 | 35 |
| | 1360 | 30 | 2.0 | 45 | 0.26 | 20 |
| 39 | 1320 | 22 | 2.0 | 25 | 0.24 | 25 |
| | 1340 | 45 | 1.9 | 36 | 0.25 | 20 |
| | 1360 | 90 | 1.7 | 90 | 0.29 | 10 |
| 40 | 1320 | 30 | 1.7 | 30 | 0.33 | 20 |
| | 1340 | 60 | 1.6 | 38 | 0.36 | 17 |
| | 1360 | 98 | 1.5 | 99 | 0.39 | 7 |

TABLE 11

| Sample | Vaccum | Nitrogen pressure (torr) | Content of nitrogen in cemented carbide |
|---|---|---|---|
| 10 | | | 0.15 |
| | | 2 | 0.18 |
| | | 10 | 0.21 |
| 11 | | | 0.18 |
| | | 2 | 0.20 |
| | | 10 | 0.24 |
| 12 | | | 0.23 |
| | | 2 | 0.26 |
| | | 10 | 0.29 |
| 13 | | | 0.37 |
| | | 2 | 0.46 |
| | | 10 | 0.53 |
| 14 | | | 0.40 |
| | | 2 | 0.62 |
| | | 10 | 0.88 |
| 15 | | | 0.37 |
| | | 2 | 0.58 |
| | | 10 | 0.81 |
| 16 | | | 0.32 |
| | | 2 | 0.45 |
| | | 10 | 0.75 |

TABLE 12

| Sample | Nitrogen pressure (torr) | Content of nitrogen in cemented carbide (%) |
|---|---|---|
| 41 | (Vacuum) | 0.16 |
| | 2 | 0.19 |
| | 10 | 0.22 |
| 42 | (Vacuum) | 0.18 |
| | 2 | 0.20 |
| | 10 | 0.25 |
| 43 | (Vacuum) | 0.22 |
| | 2 | 0.27 |
| | 10 | 0.30 |
| 44 | (Vacuum) | 0.38 |
| | 2 | 0.44 |
| | 10 | 0.50 |
| 45 | (Vacuum) | 0.40 |
| | 2 | 0.55 |
| | 10 | 0.78 |
| 46 | (Vacuum) | 0.39 |
| | 2 | 0.55 |
| | 10 | 0.80 |
| 47 | (Vacuum) | 0.30 |
| | 2 | 0.46 |

TABLE 12-continued

| Sample | Nitrogen pressure (torr) | Content of nitrogen in cemented carbide (%) |
|---|---|---|
| | 10 | 0.78 |

TABLE 13

| Sample | Test 1 (mm) | Test 2 (%) |
|---|---|---|
| 63 | 0.25 | 23 |
| 64 | 0.20 | 35 |
| 65 | 0.18 | 40 |
| 66 | 0.15 | 62 |
| Comparative example 5 | Chipped in 6 minutes | 96 |

TABLE 14

| Sample | Test 1 (mm) | Test 2 (%) |
|---|---|---|
| 67 | 0.28 | 20 |
| 68 | 0.26 | 35 |
| 69 | 0.20 | 40 |
| Comparative example 5 | Chipped in 5.5 minutes | 80 |

TABLE 15

| Sample | Thickness of layer E* (μm): Vacuum | Thickness of layer E* (μm): 5 torr $N_2$ | Test 1 (mm) | Test 2 (%) |
|---|---|---|---|---|
| 70 | 5 | — | 0.18 | 35 |
| 71 | 10 | — | 0.20 | 30 |
| 72 | 20 | — | 0.23 | 29 |
| 73 | 40 | — | 0.30 | 25 |
| 70 | — | 1 | 0.15 | 40 |
| 71 | — | 3 | 0.17 | 38 |
| 72 | — | 10 | 0.20 | 28 |
| 73 | — | 30 | 0.28 | 26 |

*It means layer in which Ti hard phase does not exist or exist in reduced amount.

What is claimed is:

1. A coated cemented carbide comprising a substrate comprising WC, at least one iron-family metal forming a binder phase and a hard phase comprising at least two elements selected from the group consisting of a carbide, nitride and carbonitride of metal that belongs to the IVa, Va and VIa groups of the Periodic Table, and at least one coating layer formed on said substrate, said coating layer comprising at least one element selected from the group consisting of a carbide, nitride, oxide and boride of a metal that belongs to the IVa, Va and VIa groups and aluminum oxide, characterized in that said substrate has, immediately under said coating layer, a surface layer having a thickness of 2–100 microns and consisting essentially of WC and at least one iron-family metal forming a binder phase, and that in said hard phase, a hard phase comprising at least one element selected from the group consisting of carbides, nitrides and carbonitrides of metal containing Zr and/or Hf as a main component coexists with a hard phase comprising at least one element selected from the group consisting of carbides, nitrides and carbonitrides of metal containing Ti as a main component, wherein the proportions of elements in the hard phase satisfies the formula:

$$0.2 \leqq M1/(M1+M2) \leqq 0.9.$$

wherein:

M1 is the molar weight of Zr and Hf in said hard phase comprising at least one element selected from the group consisting of carbides, nitrides and carbonitrides of metal containing Zr and/or Hf as a main component; and M2 is the molar weight of Ti in said hard phase comprising at least one element selected from the group consisting of carbides, nitrides and carbonitrides of metal containing Ti as a main component.

2. A coated cemented carbide as claimed in claim 1 wherein said hard phase consists essentially of at least one element selected from the group consisting of carbides, nitrides and carbonitrides of metal containing Zr and/or Hf and at least one element selected from the group consisting of carbides, nitrides and carbonitrides of metal containing Ti.

3. A coated cemented carbide as claimed in claim 1 wherein said substrate has, immediately under said surface layer, a layer having a thickness of 1–50 microns in which said hard phase comprising at least one element selected from a group consisting of carbide, nitride and carbonitride of metal containing Ti as a main component exists in a larger amount than in the portion further inside said substrate.

4. A coated cemented carbide as claimed in claim 1 wherein said substrate has, immediately under said surface layer, a layer having a thickness of 1–50 microns and comprising at least one hard phase selected from the group consisting of carbides, nitrides and carbonitrides of metal containing Ti and W as main components, and WC and a binder phase.

5. A coated cemented carbide as claimed in claim 1 wherein said substrate has, immediately under said surface layer, a layer having a thickness up to 50 microns in which only said hard phase comprising at least one element selected from a group consisting of carbide, nitride and carbonitride of metal containing Ti as a main component does not exist at all or exist in reduced amounts.

6. A coated cemented carbide as claimed in claim 1, wherein said substrate has, immediately under said surface layer, a layer having a thickness of 1–50 microns and having a maximum Hv hardness of between 1400 and 1900 kg/mm$^2$ with a load of 500 g applied.

7. A coated cemented carbide as claimed in claim 1 wherein said substrate has, immediately under said coating layer, a region which contains WC grains having a larger grain size than WC grains present further inside the substrate and which region extends to a depth of 1–100 microns.

8. A coated cemented carbide as claimed in claim 1 wherein said substrate has, immediately under said coating layer, a region which contains the binder phase in a richer amount than in the further inner portion of the substrate and which region extends to a depth of 1–100 microns.

9. A coated cemented carbide as claimed in claim 1 wherein said substrate has, immediately under said coating layer, a region which contains the binder phase in a richer amount than in the further inner portion of the substrate, and the content of the binder phase in said layer decreases continuously from a point where its content is maximum toward the surface of the cemented carbide and which region extends to a depth of 1–100 microns.

10. A coated cemented carbide as claimed in claim 1, further comprising, immediately below the coating layer, an outermost layer provided on the surface of said substrate and having a thickness of 0.01–3.00 microns, said outermost layer comprising nitrides or carbonitrides of metal containing Zr and/or Hf as a main component.

11. A coated cemented carbide as claimed in claim 1 wherein said substrate contains 0.03–0.30 wt % of oxygen.

12. A coated cemented carbide as claimed in claim 1 wherein said substrate contains 0.05–0.40 wt % of nitrogen.

* * * * *